United States Patent [19]

Olsson et al.

[11] 4,109,098

[45] Aug. 22, 1978

[54] HIGH VOLTAGE CABLE

[75] Inventors: Mats Gunnar Olsson, Stockholm; Carl Ove Tollerz, Bromma; Sven Gunnar Wretemark, Stockholm, all of Sweden

[73] Assignee: Telefonaktiebolaget L M Ericsson, Stockholm, Sweden

[21] Appl. No.: 719,368

[22] Filed: Sep. 1, 1976

Related U.S. Application Data

[63] Continuation-in-part of Ser. No. 681,768, Apr. 29, 1976, abandoned, which is a continuation of Ser. No. 540,870, Jan. 14, 1975, abandoned.

[51] Int. Cl.[2] ..... H01B 9/02

[52] U.S. Cl. ..... 174/106 SC; 174/105 SC; 174/107; 174/120 SC

[58] Field of Search ..... 174/102 SC, 105 SC, 174/106 SC, 120 SC, 127, 107

[56] References Cited

U.S. PATENT DOCUMENTS

| | | | |
|---|---|---|---|
| 3,187,071 | 6/1965 | Radziejowski | 174/105 SC X |
| 3,643,004 | 2/1972 | McKean | 174/105 SC X |
| 3,666,876 | 5/1972 | Forster | 174/105 SC |
| 3,878,319 | 4/1975 | Wahl | 174/106 SC |

*Primary Examiner*—Elliot A. Goldberg
*Attorney, Agent, or Firm*—Hane, Roberts, Spiecens & Cohen

[57] ABSTRACT

A cable for carrying high voltage has encompassed on its metallic conductor core with an inner layer of semiconducting material. An insulation layer encompasses this semiconducting layer and is in turn encompassed by an outer semiconducting layer. This outer semiconducting layer is strongly bonded to the underlying insulation layer and its outer surface resistivity is selected to be within the range of $10^7 - 10^9$ ohm/square. Such resistivity range equalizes the voltage distribution within the cable jacket and also facilitates splicing cable ends and terminating the cable as the outer semiconducting layer need not and in fact cannot be readily removed.

6 Claims, 2 Drawing Figures

HIGH VOLTAGE CABLE

The present application is a continuation-in-part application based on continuing application Ser. No. 681,768, filed Apr. 29, 1976, now abandoned which in turn is a continuation of application Ser. No. 540,870, filed Jan. 14, 1975 and now abandoned.

The present invention relates to a high voltage cable with a layer of synthetic insulation and a semiconducting layer outside the insulation layer. More specifically, the invention relates to a high voltage cable in which this outer semiconducting layer has a predetermined conductivity.

BACKGROUND

In a high voltage cable as now known, an inner semiconducting tape or layer is wound or extruded about the metal conductor of the cable and a layer of insulation is extruded about this inner layer. A ground screening shielding element is then applied concentrically about the insulation layer. This element usually consists of a semiconducting layer and a metallic ground return screen, whereby an even equipotential surface about the insulation layer is provided. A careful examination of the current proportions shows that the outer semiconducting layer conducts a capacitive current across the layer in radial direction from the metal conductor to the surrounding screen. Furthermore, a resistive current appears in the layer. This current equalizes the voltages which, due to possible non-uniform field distribution, appears in peripheral direction. On the metallic shield or screen nearest to the outer semiconducting layer the surrounding cable sheath can be applied.

With cables having some form of extruded plastic or rubber insulation, the inner semiconductor is usually applied by the same operation as the insulation layer. It has been found to be preferable to apply also the outer semiconducting layer in the same operation, that is, as a so-called triple extrusion. The semiconducting layer and the insulation material then adhere well together and thus result in a mechanically and electrically reliable product. Triple extrusion has primarily been used at the highest voltages but only if specialist installation personnel is available.

One problem with high voltage cables as previously known, is to have available the expertise and equipment to assemble the cable reliably and yet economically. Preparation of the cable assembly requires that parts of the cable sheath are removed together with the screening layers and the insulation layer to be able to connect the conductor. With now known cable constructions, it is the practice, in order to facilitate the preparation of the cable, to manufacture the outer semiconductor as tapes which are directly applied upon the insulation or as layers painted or sprayed outside the insulation layer and semiconducting tapes outside the painted layer.

It is also known to extrude upon the insulation a "tire" of, for example, semiconducting rubber which tightens around the insulation layer. The disadvantage of these measures is primarily that corona can occur in the air gaps which are left at the overlap of the semiconducting layers. Also, gaps can occur between loosely applied semiconducting layer and the insulation due to mechanical and thermal stresses. The semiconducting paint may be difficult to remove, specially if it has burnt onto the underneath laying layer due to overheating. At the ends of the cable, where the semiconductor according to known methods has to be removed for a certain length from the connection point, high longitudinal field forces may appear at the thus formed screen edge. It is previously known to decrease the field force at an abruptly ending shield or screen by arranging layers having a selected resistivity outside the insulation and a length extending from the screen edge to the conductor. As a result, part of the ground return current of the cable will flow through the resistive layer and thus causes a spread potential rise which decreases the field force and prevents corona in the air. Other field force equalizing modes are also known which require special material or special accessories, high skill of the asembler and time-consuming work. Particularly troublesome is the complete removal of the semiconducting layer, especially when the layer material adheres to the insulating surface. Accordingly, attempts have been made to manufacture semiconducting layers which can be easily and completely separated from the insulation surface. However, the easier it is to strip the semiconductor material, the greater is the risk for damages due to stresses.

THE INVENTION

It is an object of the present invention to provide a novel and improved cable comprising one or a multiple core cable, several cable cores, each of which including an outer semiconducting layer having good electrical and mechanical stability which also eliminates the present inconvenience when terminating the cable.

Other objects, features and advantages of the invention will be pointed out hereinafter and set forth in the appended claims.

In the accompanying drawing, an embodiment of the invention is shown by way of illustration and not by way of limitation.

IN THE DRAWING

DETAILED DESCRIPTION

The illustrated embodiment of the invention and the description thereof refers to a single core cable but the inventive concept is readily applicable to a separate core of a multiple core cable.

Figure 1:
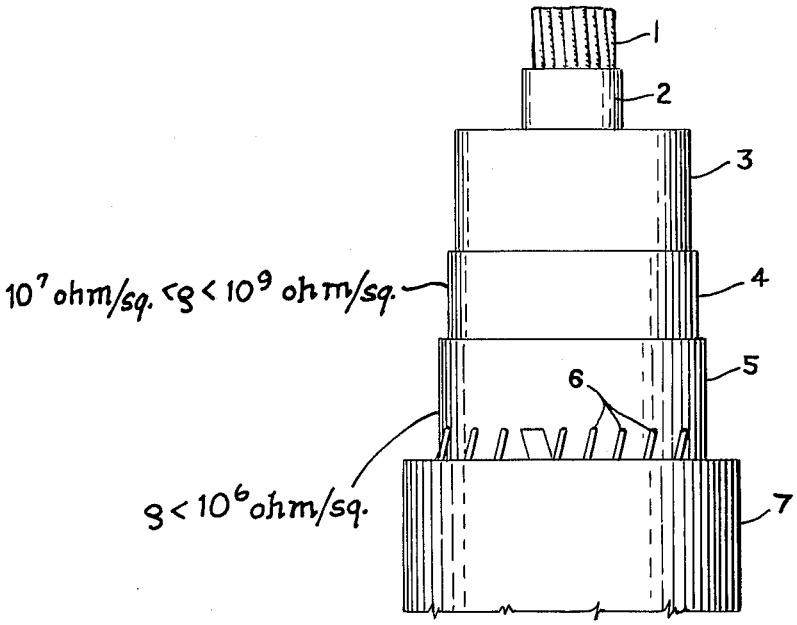
FIG. 1 is a view, partly in section, of a cable according to the invention.

In the cable according to FIG. 1, there is shown a conductor 1 consisting of, for example, twisted and packed wires. This conductor is covered by an inner semiconducting layer 2 in the form of semiconducting tapes 2 or extruded semiconducting material such as thermoplastic to equalize the voltage stresses as caused by the individual wires of the inner conductor, and an outer insulation layer 3 consisting of, for example, polyethylene material and having a thickness which is determined by the voltage for which the cable is rated. The insulation layer 3 is covered by an outer semiconducting layer 4 consisting, for instance, of polyethylene material containing admixtures of carbon and produced by extrusion and subsequent vulcanization. With cables of known kind, the surface resistivity of the outer semiconducting layer as measured longitudinally along the outer surface of the cable core, is low at most about $10^6$ ohm/square. As a result, a field pattern in the cable is obtained which shows small voltage gradients in tangential direction at frequencies higher than the power frequency, for example, at transient occurrences (flash of lightning and the like). Calculations show, however, that the surface or sheet resistivity of the layer can be increased considerably more than the usual values $10^2$ – $10^4$ ohm/square used in practice without sacrificing reliability of service.

According to the invention, a range between $10^7$ to $10^9$ ohm/square is chosen. Within that range, the advantages of the semiconducting layer 4 as field equalizing resistance is essentially maintained, yet further advantages will be attained at an end of the cable as it will be described in detail in connection with FIG. 2.

The high ohmic semiconducting layer can consist, for example, of polyethylene material containing admixtures of carbon, for example, carbon black, to obtain the desired resistivity. The layer may be applied by extrusion, preferably by triple extrusion, as such extrusion results in the best electrical and mechanical stability. It is also possible to apply the outer semiconducting layer by means of continuous lacquering with a high ohmic lacquer layer in essentially the same manner as is heretofore applied to low ohmic layers. For example, the semiconducting layer 4 can be applied by spraying, dipping or by electrostatic painting whereby a strong bond to the underlying insulation layer is obtained. The extruded outer semiconductor according to the invention can be a type elastomer, thermoplastic material or cross-bound plastic (vulcanized) which all in the manufacturing process can be caused to be completely and strongly bonded to the insulation surface whereby the risk of occurrence of corona is eliminated. As described before, a loose application of the semiconducting layer 4 may be dangerous as occurrence of corona gaps is likely. By bonding layer 4 to layer 3 in accordance with the invention this danger is eliminated. As with the cable of the invention layer 4 need not be removed for connecting the cable, the bonding step of the invention can be conveniently used. In certain cases the high ohmic semiconducting layer 4 can be completed with an applied layer 5 of electrically conducting plastic material, textile, synthetic fiber or the like having a resistivity value of conventional magnitude. The material forming outer layer 5 can be removed for the preparation of connecting a cable and to another circuit component, thus in no way interfering with the object of invention.

Figure 2:
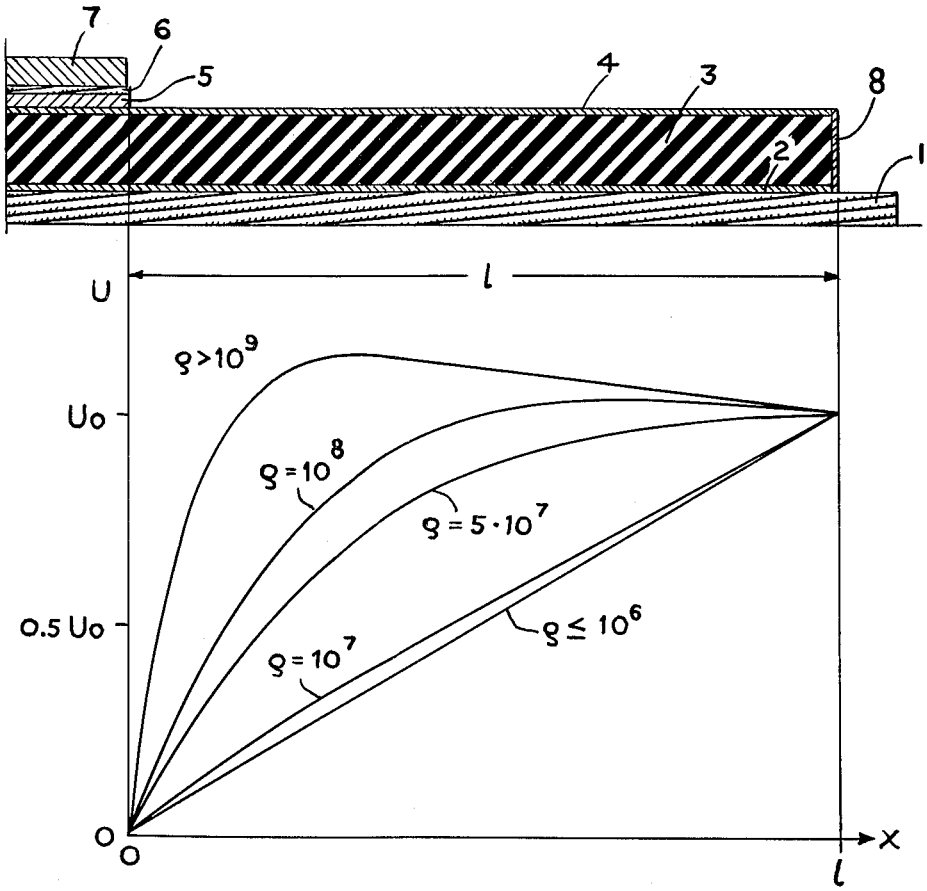
FIG. 2 shows diagrammatically the voltage gradient at an end of a cable, only half of the cable being shown, according to the invention.

In FIG. 2, the voltage distribution along a cable termination is shown to illustrate the advantage of the invention. The cable termination or end is shown in a longitudinal section and like in FIG. 1, the inner conductor is designated by 1, to which the inner semiconducting layer 2 is applied. The insulation 3 is covered by the outer semiconducting layer 4 and in order to discharge the field currents to ground, a grounded metallic shield or screen 6, for example a copper wire, is applied in a conventional manner. Screen or shield 6 is jacketed by a cable mantle 7 made, for instance, of lead or polyvinyl chloride. Beneath this shield there can be provided a further semiconducting layer 5.

By $U_o$ the potential of the conductor is designated, for example $12/\sqrt{3}$ or $24/\sqrt{3}$ kV, the shield 6 having the potential O. Close to the end of the cable the grounded screen 6 is removed together with the additional semiconducting layer 5, so that an end part length L of the outer semiconducting layer 4 is uncovered. Furthermore, part of the inner semiconducting layer 2 and the insulation layer 3 have been removed, so that the conductor 1 is uncovered at the end of the cable. The outer semiconducting layer 4 is brought into electrical contact with the conductor 1 at the free end of the cable, for example, by applying some layers of semiconducting tape 8.

The voltage distribution which develops in the outer semiconducting layer 4 along the length between the screen 6 and the conductor 1 is of importance. At a too high voltage gradient an undesirable corona may occur at voltage tests as are required for high voltage cables. Such coronas will appear at the screen edge of conventional cable constructions at the screen edge, i.e., the edge which is formed when the insulation layer 3 of the cable is uncovered, unless special measures are taken. With a cable construction according to the present invention, this layer 3 covering the outer semiconducting layer 4 is not removed thereby accomplishing its function to equalize the longitudinal field between the outer screen 6 and the inner conductor 1. The diagram in FIG. 2 shows that by a semiconducting layer such as layer 4 the resistivity of which has been selected according to the concept of the invention, a uniform voltage distribution along the uncovered portion of conductor 1 is obtained. The pattern of the voltage distribution is shown for different values of the resistivity $\rho$ of the outer semiconducting layer 4. As is shown for a certain value $\rho = 10^7$ ohm/square an approximately linear voltage distribution can be obtained.

According to the invention, the resistivity range $10^7$ – $10^9$ ohm/square is the safest range for the surface resistivity of the outer semiconducting layer 4. At values above $10^9$ ohm/square there is a danger that too high voltage gradients may occur near the screen edge (at 6 in FIG. 2). At values between $10^2$ – $10^4$ there is a risk that the power generation in the semiconducting layer 4 would cause fire. At values below $10^7$ ohm/square, creeping current paths and surface flash-over will occur.

If a too high value, that is above $10^9$ ohm/square were chosen, then the voltage gradient and thus the field force at the screens edge would increase and assume such a high value that corona would occur at the screen edge. Conversely, if the chosen value is below $10^7$ ohm/square, then in practice concentrated creeping current paths and surface flash-over will occur if such a semiconducting layer 4 is not completely homogeneous. In FIG. 2 there is also plotted the voltage distribution for resistivity values equal and above $10^9$ ohm/square. It is obvious, for resistivity values equal and above $10^9$, that a higher voltage gradient near the screen edge is obtained which can cause glow or corona at the screen edge. Resistivity values equal or lower than $10^7$ give a linear voltage distribution, but the problem at these resistivity values is either the power generation due to low resistivity, creeping current paths and/or flash over.

What is claimed is:

1. A high voltage cable comprising:

an inner conductor, an inner semiconducting layer surrounding said conductor, an insulation layer surrounding said inner semiconducting layer, an outer semiconducting layer surrounding said insulation layer, said outer semiconducting layer being strongly bonded to said insulation layer and having an electrical surface resistivity measured along the outer surface of the outer semiconducting layer and being within the range of $10^7$ and $10^9$ ohm/square and essentially voltage independent;

a further semiconducting layer surrounding said outer semiconducting layer in surface engagement therewith, said further semiconducting layer having an outer sheet resistivity of at most $10^6$ ohm/-square;

shielding means including metal wires encompassing said further semiconducting layer;

said cable further comprising an end for connection purposes at which said shielding means and said further semiconducting layer being removed to leave said inner conductor projecting therebyond covered, in succession, by said inner semiconducting layer, said insulation layer and said outer semiconducting layer, and a semiconductor connection between said outer semiconducting layer and said inner conductor, the combination of said value of surface resistivity of said outer semiconducting layer and said bonding of the outer semiconducting layer to said insulation layer providing a voltage gradient between the free end of the inner conductor and the edge of the shielding means of sufficiently low value to prevent corona at the edge of the shielding means while minimizing creeping current paths and flash over.

2. A cable according to claim 1 wherein said outer semiconducting layer is made of a synthetic plastic material.

3. A cable according to claim 2 wherein said outer semiconducting layer is an extruded layer.

4. A cable according to claim 1 wherein said outer semiconducting layer is a sprayed-on layer.

5. A cable as claimed in claim 1 wherein the material of said outer semiconducting layer includes an admixture of conducting material, selected to obtain said outer surface resistivity.

6. A cable according to claim 5 wherein said admixture consists of carbon.

* * * * *

UNITED STATES PATENT OFFICE

CERTIFICATE OF CORRECTION

PATENT NO. : 4,109,098

DATED : August 22, 1978

INVENTOR(S) : Mats Gunnar Olsson etal

It is certified that error appears in the above-identified patent and that said Letters Patent are hereby corrected as shown below:

Foreign Application Priority Data

January 31, 1974 Sweden 74.01244

Signed and Sealed this

Sixth Day of March 1979

[SEAL]

*Attest:*

RUTH C. MASON
*Attesting Officer*

DONALD W. BANNER
*Commissioner of Patents and Trademarks*